US006664743B2

(12) United States Patent
Langeslag et al.

(10) Patent No.: US 6,664,743 B2
(45) Date of Patent: Dec. 16, 2003

(54) LOW LOSS OPERATING CIRCUIT FOR A DISCHARGE LAMP

(75) Inventors: Wilhelmus Hinderikus Maria Langeslag, Nijmegen (NL); Arnold Willem Buij, Eindhoven (NL); Machiel Antonius Martinus Hendrix, Eindhoven (NL); Antonius Henricus Peterus Johannes Habraken, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 3 days.

(21) Appl. No.: 10/078,977

(22) Filed: Feb. 19, 2002

(65) Prior Publication Data

US 2002/0113557 A1 Aug. 22, 2002

(30) Foreign Application Priority Data

Feb. 21, 2001 (EP) ..... 01200617

(51) Int. Cl.[7] ..... H05B 37/02
(52) U.S. Cl. ..... 315/209 R; 315/224
(58) Field of Search ..... 315/209 R, 291, 315/224, 219, 307, DIG. 7, DIG. 5, 225, 226; H05B 37/02

(56) References Cited

U.S. PATENT DOCUMENTS 4,170,747 A * 10/1979 Holmes ..... 315/307
5,113,120 A * 5/1992 Scott et al. ..... 315/77
6,005,353 A * 12/1999 Blom ..... 315/209 R

FOREIGN PATENT DOCUMENTS

WO WO9902020 1/1999 ..... H05B/41/29

* cited by examiner

*Primary Examiner*—Don Wong
*Assistant Examiner*—Trinh Vo Dinh

(57) ABSTRACT

In an inverter for operating a discharge lamp by means of an AC current comprising two switching elements, the effect of hard switching is counteracted by means of a snubber comprising two inductive elements and at least two diodes.

20 Claims, 2 Drawing Sheets

LOW LOSS OPERATING CIRCUIT FOR A DISCHARGE LAMP

This invention relates to a circuit arrangement for feeding a lamp comprising

- a first input terminal K1 and a second input terminal K2 which are to be connected to a supply voltage source supplying a DC voltage,
- an inverter for generating a square-wave periodic voltage from said DC voltage, which inverter is provided with a series arrangement of a first switching element S1, a first inductive element L1, a second inductive element L2 and a second switching element S2, and which inverter interconnects the input terminals,
- a control circuit which is coupled to a control electrode of the first switching element S1 and to a control electrode of the second switching element S2, which control circuit is used to generate a control signal for rendering the first and the second switching element alternately conducting and non-conducting,
- a load branch comprising a third inductive element L3, lamp terminals for connecting the lamp, and a first capacitive element C1,
- a first unidirectional element D1 having an anode coupled to the second input terminal K2 and a cathode coupled to a point between the first switching element S1 and the first inductive element L1,
- a second unidirectional element D2 having a cathode coupled to the first input terminal K1 and an anode coupled to a point between the second switching element S2 and the second inductive element L2.

Such a circuit arrangement is disclosed in WO-9902020. In the known circuit arrangement, the control circuit is also provided with a dimmer circuit for dimming the lamp by regulating the duty cycle of the control signal. In addition, the self-inductances L1', L2' and L3' of, respectively, the first, the second and the third inductive element L1, L2 and L3 are chosen so as to be substantially equal to each other. The first and the second inductive element are magnetically coupled to each other and hence jointly form a transformer. As a result of said values of the self-inductances and by virtue of this magnetic coupling, it is achieved that the shape of the current through the lamp during dimming the lamp comes fairly close to a sine shape. In other words, the lamp current comprises comparatively few higher harmonic terms, as a result of which the amount of disturbance generated by the lamp is limited. In addition, in the known circuit arrangement, acoustic resonances are effectively suppressed. In a part of the range wherein the duty cycle of the control signal can be regulated "hard switching" occurs. This means that each one of the switching elements is rendered conducting while a comparatively high voltage is present across the switching element. This may give rise to a comparatively high power dissipation in the switching elements. In the known circuit arrangement, this power dissipation is counteracted to a limited extent only as a result of the fact that the first and the second inductive element are arranged in series with the switching elements. In addition, a drawback of the known circuit arrangement resides in that the transformer formed by the first and the second inductive element is a comparatively expensive and bulky component.

SUMMARY OF THE INVENTION

It is an object of the invention to provide a circuit arrangement wherein the power dissipation caused by "hard switching" is effectively counteracted using comparatively straightforward, inexpensive and small components.

To achieve this object, a circuit arrangement as mentioned in the opening paragraph is characterized, in accordance with the invention, in that with respect to the self-inductances L1', L2' and L3' of, respectively, the first, second and third inductive element, the following relationship applies;

$$L3' > 5 * L1' \text{ and } L3' > 5 * L2'.$$

In a circuit arrangement in accordance with the invention, power dissipation in the switching elements due to "hard switching" is substantially suppressed in spite of the comparatively small self-inductances of the first and the second inductive element. Power that would be dissipated in the switching elements, if the first and the second inductive element and the first and the second unidirectional element were absent, is effectively fed back to the supply voltage source or used to generate a current through the lamp. It has been found that this applies if the first and the second inductive element are magnetically coupled, but also if the inductive elements are not coupled.

It has been found that in many cases power dissipation is very effectively counteracted if with respect to the self-inductances L1', L2' and L3' of, respectively, the first, second and third inductive element, it applies that $$L3' > 10 * L1' \text{ and } L3' > 10 * L2'.$$

It has also been found that power dissipation can be further reduced if the circuit arrangement is additionally provided with a third unidirectional element D3 and a fourth unidirectional element D4, with a cathode of the third unidirectional element D3 being coupled to the first input terminal K1, an anode of the fourth unidirectional element D4 being coupled to the second input terminal K2 and an anode of the third unidirectional element D3 and a cathode of the fourth unidirectional element D4 each being coupled to a point between the first inductive element L1 and the second inductive element L2.

As the circuit arrangement comprises parasitic capacitances, oscillations occur which are brought about by the first and the second inductive element and said parasitic capacitances. By means of the third and the fourth unidirectional element it is achieved that the amplitude of voltages caused by these oscillations, particularly of the voltage on the point between the first and the second inductive element, remains limited. A further reduction of the power dissipation is thus achieved. In addition, the unidirectional elements D3 and D4 form part of current paths for "reverse" currents having a small impedance. As a result, in the case of "hard switching", the third unidirectional element D3 carries current, not the second unidirectional element D2, for rendering the second switching element S2 conducting. Correspondingly, the fourth unidirectional element D4 carries current, not the first unidirectional element D1, for rendering the first switching element S1 conducting. By virtue thereof, power dissipation in the first and the second unidirectional element and the switching elements is limited substantially when the switching elements are becoming conducting.

Field effect transistors such as MOSFETs are often used as the switching elements in a circuit arrangement in accordance with the invention. Such field effect transistors comprise an internal diode that is capable of guiding the current in a direction that is in opposition to the direction in which the field effect transistor carries current in the conducting state. These internal diodes play an important part in the functioning of the circuit arrangement since they carry current during specific operational phases of the circuit arrangement. If these internal diodes are comparatively slow, then a comparatively high power dissipation occurs when said internal diodes become non-conducting. This contribution to the power dissipation can be reduced substantially if the circuit arrangement is additionally provided with a fifth unidirectional element D5 which is arranged in series with the first switching element S1, a sixth unidirectional element D6 which is arranged in series with the second switching element S2, a first shunt branch which comprises a seventh unidirectional element D7 and shunts the series arrangement of the fifth unidirectional element D5 and the first switching element S1, and a second shunt branch which comprises an eighth unidirectional element D8 and shunts the series arrangement of the sixth unidirectional element D6 and the second switching element S2. Said unidirectional elements D5–D8 being chosen so as to operate at a comparatively high speed with respect to the internal diodes of the switching elements S1 and S2.

As indicated hereinabove, "hard switching" occurs particularly in a circuit arrangement wherein the control circuit is provided with a dimmer circuit for regulating the duty cycle of the control signal. Consequently, the invention can very advantageously be used in such circuit arrangements.

Controlling the luminous flux of the lamp by means of a dimmer circuit for regulating the duty cycle of the control signal can be very advantageously applied in circuit arrangements which are intended to feed lamps of a different type, since the relation between the duty cycle of the control signal and the luminous flux of the lamp is very similar for lamps of a different type. Such circuit arrangements intended to feed lamps of different types are generally provided with a circuit part for recognizing the type of lamp connected to the lamp terminals.

BRIEF DESCRIPTION OF THE DRAWINGS

Examples of a circuit arrangement in accordance with the invention will be explained in greater detail with reference to the accompanying drawing. In the drawing.

DESCRIPTION OF THE PREFERRED EMBODIMENTS

Figure 1:
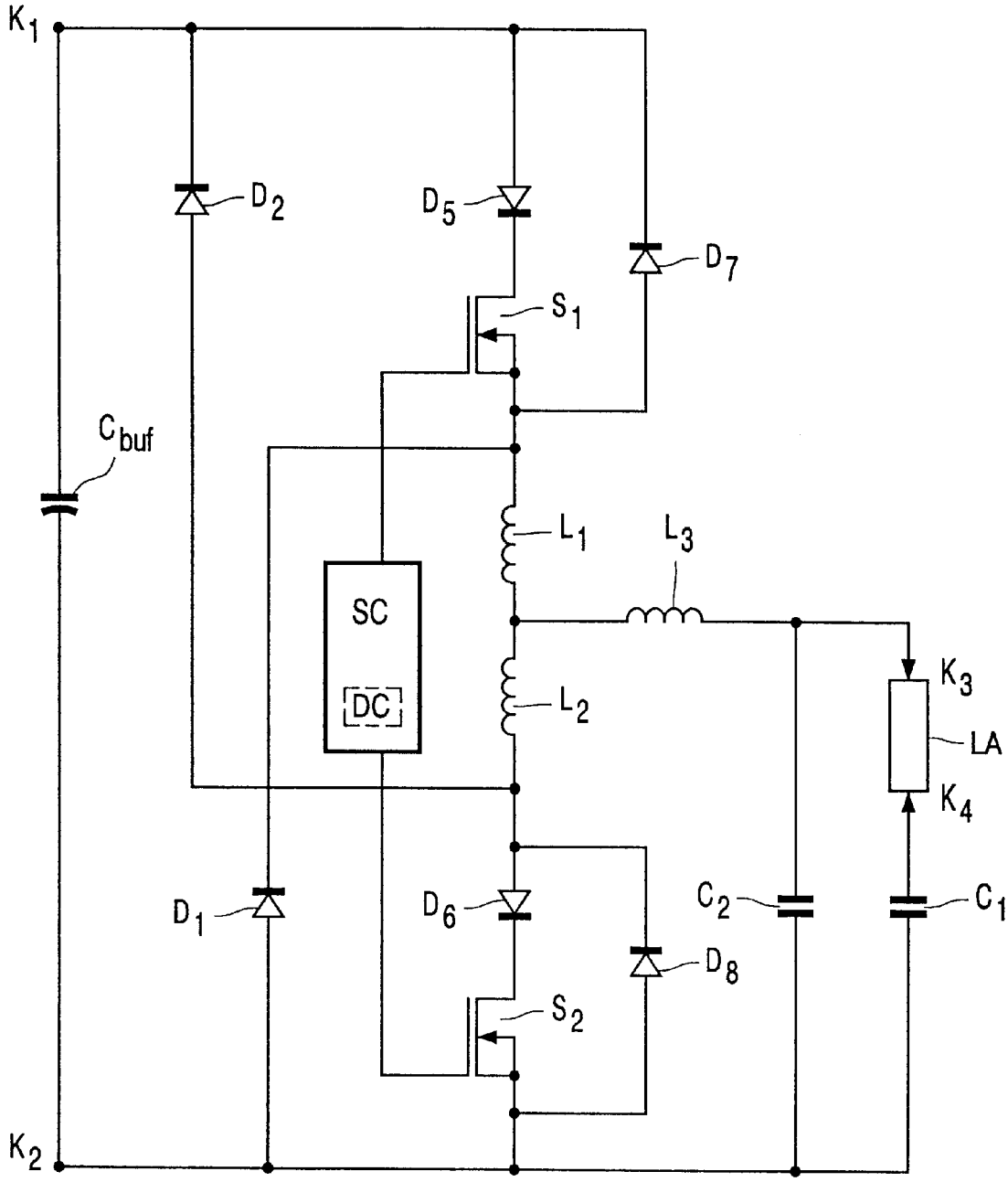
FIG. 1.

In FIG. 1, K1 and K2 are input terminals which are to be connected to a supply voltage source supplying a DC voltage. Such a supply voltage source can be, for example, an AC source, such as the mains, provided with a rectifier. Input terminals K1 and K2 are connected to each other by means of a buffer capacitance Cbuf. The buffer capacitance Cbuf is shunted by a series arrangement of diode D5, switching element S1, coil L1, coil L2, diode D6 and switching element S2. A junction paint of coil L1 and switching element S1 is connected to input terminal K2 by means of diode D1. A junction point of coil L2 and switching element S2 is connected to input terminal K1 by means of diode D2. Circuit part SC is a control circuit for generating a control signal for rendering switching element S1 and switching element S2 alternately conducting and non-conducting. For this purpose, a first output of circuit part SC is coupled to a control electrode of switching element S1, and a second output of circuit part SC is coupled to a control electrode of switching element S2. The circuit part SC is provided with a dimmer circuit DC for regulating the duty cycle of the control signal. The series arrangement of diode D5 and switching element S1 is shunted by diode D7. The series arrangement of diode D6 and switching element S2 is shunted by diode D8. A junction point of coil L1 and coil L2 is connected to input terminal K2 by means of a series arrangement of coil L3, lamp terminal K3, lamp La, lamp terminal K4 and capacitor C1. Lamp terminal K3 is connected to input terminal K2 by means of capacitor C2. Diodes D5–D8, switching elements S1 and S2, and coils L1 and L2 jointly form an inverter for generating a square-wave periodic voltage from the DC voltage supplied by the supply voltage source. Coil L3, lamp terminals K3 and K4, lamp LA and capacitors C1 arid C2 form, in this example, a load branch. Diodes D1, D2 and D5–D8 form, respectively, a first, a second and a fifth to an eighth unidirectional element. The self-inductances L1', L2' and L3' of coils L1, L2 and L3 are chosen such that the following applies:

$$L3' > 10 * L1' \text{ and } L3' > 10 * L2'.$$

Next, a description is given of the operation of the example shown in FIG. 1. When the input terminals K1 and K2 are connected to a supply voltage source supplying a DC voltage, then the circuit part SC renders the switching elements S1 and S2 alternately conducting and non-conducting. As a result, a substantially square-wave voltage is present across the load branch. Under the influence of this substantially square-wave voltage, an alternating current flows through the load branch, which feeds the lamp and the frequency of which is equal to that of the substantially square-wave voltage. The lamp can be dimmed by regulating the duty cycle of the control signal by means of the dimmer circuit DC. In a part of the range in which the duty cycle can be regulated "hard switching" occurs, i.e. each switching element is rendered conducting while a comparatively high voltage is present across the switching element. However, as the coils L1 and L2 are arranged in series with the switching elements, the current through each switching element can increase only to a limited extent when said switching element is becoming conducting, as a result of which the amount of power dissipated in the switching element remains limited. The electric energy stored in the coil L1 when the switching element S1 is in the conducting state causes a current to flow from a first end of coil L1, which is formed by a junction point of coil L1 and coil L2, via the load branch and diode D1 to a second end of coil L1. In this manner, the electric energy stored in coil L1 is used, when the switching element S1 is in the conducting state, to generate a current through the lamp. The electric energy stored in coil L2 when the switching element S2 is in the conducting state causes a current to flow from a first end of coil L2, which is formed by a junction point of coil L2 and diode D2, via diode D2 and capacitor Cbuf and the load branch to a second end of coil L2. In this manner, the electric energy stored in coil L2 is partly transferred, when the switching element S2 is in the conducting state, to the supply voltage source, and is partly used to generate a current through the lamp. In the case of "hard switching", the diodes are conducting also before the switching elements become conducting. The current through coil L3 flows in the direction of lamp terminal K3 during a time interval before the first switching element S1 becomes conducting. This current flows partly through diode D1 and coil L1, and partly through diode D8 and coil L2. During a time interval before the second switching element S2 becomes conducting, the current flows through coil L3 in the direction of the junction point of coil L1 and coil L2. This current flows partly through coil L1 and diode D7, and partly through coil L2 and diode D2.

Figure 2:
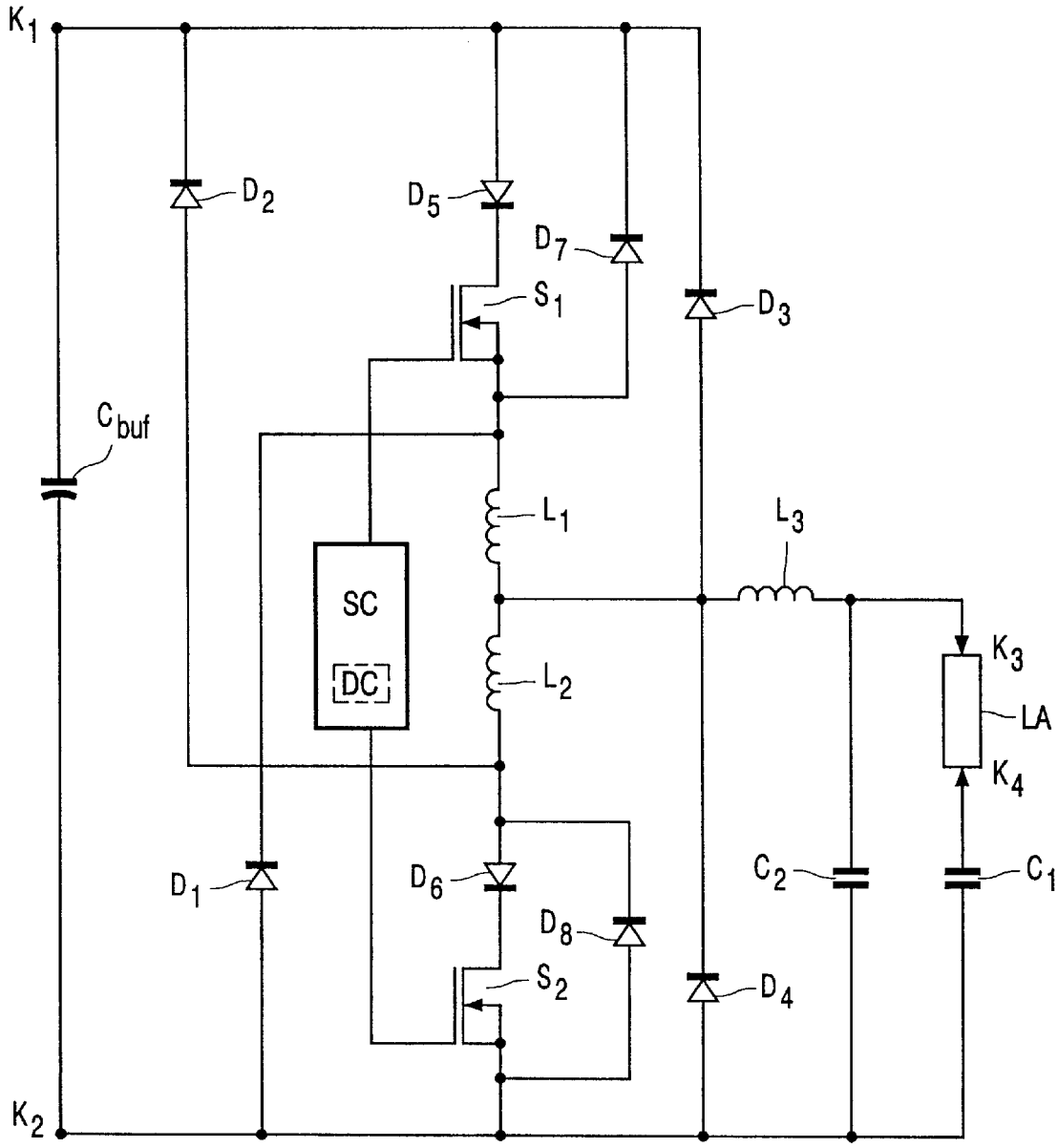
FIG. 2 show, respectively, a first and a second example of a circuit arrangement in accordance with the invention to which a lamp is connected.

In FIG. 2, components and circuit parts that correspond to components and circuit parts shown in the example of FIG. 1 are indicated by means of the same reference numerals. The only difference between the example shown in FIG. 2 and the example shown in FIG. 1 is that the circuit arrangement of FIG. 2 additionally comprises diodes D3 and D4, which, in the example shown in FIG. 2, form, respectively, a third and a fourth unidirectional element. Diode D3 connects a junction point of coils L1 and L2 to input terminal K1. Diode D4 connects input terminal K2 to a junction point of coils L1 and L2.

The operation of the example shown in FIG. 2 corresponds substantially to the operation of the example shown in FIG. 1. However, the presence of diodes D3 and D4 substantially limits the amplitude of, in particular, the voltage on the junction point of coil L1 and coil L2, which is caused by an oscillation of parasitic capacitances in the circuit arrangement and the coils L1 and L2. As a result, a further reduction of the power dissipation in the circuit arrangement is achieved.

In addition, the unidirectional elements D3 and D4 form part of current paths for "reverse" currents having a small impedance. If, for example, the current through coil L3 flows in the direction of the junction point of coils L1 and L2 before the switching element S2 is rendered conducting, then this current flows through diode D3, and not, or hardly, through coil L1 and diode D7, and coil L2 and diode D2. When the switching element S2 becomes conducting, the amount of current that flows in the reverse direction through diode D3 remains limited by virtue of the presence of coil L2 between diode D3 and switching element S2. As a result, power dissipation in diode D3 and switching element S2 is limited. However, in the absence of diode D3, as in the example shown in FIG. 1, the current flows through coil L3, before the switching element S2 becomes conducting, and through coil L1 and diode D7, and through coil L2 and diode D2. When the switching element S2 becomes conducting, in this case, a comparatively high reverse current flows through diode D2 causing a comparatively large power dissipation in diode D2 and switching element S2. When the current through coil L3 flows in the direction of the lamp terminal K3, before the switching element S1 becomes conducting, diode D4 carries current, while diode D8 and coil L2, or diode D1 and coil L1 do not carry current. When the switching element S1 becomes conducting, the reverse current through diode D4 is limited by the presence of coil L1 between switching element S1 and diode D4. As a result, power dissipation in diode D4 and switching element S1 is limited. In the absence of diode D4, however, the current flows through coil L3 before the switching element S1 becomes conducting, and through coil L1 and diode D1, and through coil L2 and diode D8. When the switching element S1 becomes conducting, in this case, a comparatively large reverse current flows through diode D1 causing a comparatively large power dissipation in diode D1 and switching element S1.

For practical embodiments of the examples shown in FIG. 1 and FIG. 2, and of a circuit arrangement wherein the coils L1 and L2, and the diodes D1–D4 are not provided, the following results were found. In all cases, the power consumed by the lamp was 1 Watt. Coils L1 and L2 had a self-inductance of 100 $\mu$H, coil L3 had a self-inductance of 1.1 mH. The buffer capacitance had a capacitance value of 22 nF. Capacitor C1 had a capacitance of 220 nF and capacitor C2 had a capacitance of 6.8 nF. Power dissipation was highest in the circuit arrangement wherein coils L1 and L2 as well as diodes D1–D4 had not been provided. The power dissipation of the practical embodiment of the example shown in FIG. 1 was 1.3 Watt lower, while the power dissipation of the practical embodiment of the example shown in FIG. 2 was approximately 1 Watt lower than that of the practical embodiment of the example shown in FIG. 1.

What is claimed is:

1. A circuit arrangement for feeding a lamp comprising a first input terminal and a second input terminal which are to be connected to a supply voltage source supplying a DC voltage, an inverter for generating a square-wave periodic voltage from said DC voltage, the inverter including a series arrangement of a first switching element, a first inductive element, a second inductive element and a second switching element, and which inverter interconnects the input terminals, a control circuit coupled to a control electrode of the first switching element and to a control electrode of the second switching element, the control circuit generating a control signal for rendering the first and the second switching element alternately conducting and non-conducting, a load branch comprising a third inductive element, lamp terminals for connecting the lamp, and a first capacitive element, a first unidirectional element having an anode coupled to the second input terminal and a cathode coupled to a point between the first switching element and the first inductive element, a second unidirectional element having a cathode coupled to the first input terminal and an anode coupled to a point between the second switching element and the second inductive element, characterized in that the self-inductances L1', L2' and L3' of, respectively, the first, second and third inductive element, satisfy the following relationship;

$$L3'>5*L1' \text{ and } L3'>5*L2'.$$

2. The circuit arrangement as claimed in claim 1, wherein the self-inductances L1', L2' and L3' of, respectively, the first, second and third inductive element, satisfy the following relationship;

$$L3'>10*L1' \text{ and } L3'>10*L2'.$$

3. The circuit arrangement as claimed in claim 1, further comprising; a third unidirectional element and a fourth unidirectional element, with a cathode of the third unidirectional element being coupled to the first input terminal, an anode of the fourth unidirectional element being coupled to the second input terminal and an anode of the third unidirectional element and a cathode of the fourth unidirectional element each being coupled to a point between the first inductive element and the second inductive element.

4. The circuit arrangement as claimed in claim 3, further comprising; a fifth unidirectional element arranged in series with the first switching element, a sixth unidirectional element which is arranged in series with the second switching element, a first shunt branch which comprises a seventh unidirectional element in shunt with the series arrangement of the fifth unidirectional element and the first switching element, and a second shunt branch, which comprises an eighth unidirectional element, in shunt with the series arrangement of the sixth unidirectional element and the second switching element.

5. The circuit arrangement as claimed in claim 1, wherein the control circuit includes a dimmer circuit for regulating the duty cycle of the control signal.

6. The circuit arrangement as claimed in claim 1, further comprising; a circuit part for recognizing the type of lamp connected to the lamp terminals.

7. The circuit arrangement as claimed in claim 1 further comprising:

a third unidirectional element coupled in series with the first switching element, a fourth unidirectional element coupled in series with the second switching element, a first shunt branch, which comprises a fifth unidirectional element, in shunt with the series circuit of the third unidirectional element and the first switching element, and a second shunt branch, which comprises a sixth unidirectional element, in shunt with the series circuit of the fourth unidirectional element and the second switching element.

8. The circuit arrangement as claimed in claim 1 further comprising third and fourth unidirectional elements connected in series aiding to the first and second input terminals and with a first circuit point therebetween coupled to a second circuit point between the first and second switching elements.

9. The circuit arrangement as claimed in claim 8 wherein the series arrangement of elements of the inverter are connected in the order named between the first and second input terminals and the second circuit point is located between the first and second inductive elements.

10. The circuit arrangement as claimed in claim 1 further comprising:

a third unidirectional element coupled in series with the first switching element, and a fourth unidirectional element coupled in series with the second switching element.

11. A circuit for operating a discharge lamp comprising:

first and second input terminals for connection to a source of DC supply voltage for the circuit, an inverter coupled to the first and second input terminals and comprising a series circuit of a first controlled switching element, a first inductive element, a second inductive element and a second controlled switching element, a control circuit coupled to respective control electrodes of the first and second controlled switching elements to drive the first and second controlled switching elements alternately conducting and non-conducting, a load branch comprising a third inductive element, lamp terminals for connection to the discharge lamp, and a first capacitive element, a first unidirectional element coupled between the second input terminal and a circuit point between the first controlled switching element and the first inductive element, a second unidirectional element coupled between the first input terminal and a circuit point between the second controlled switching element and the second inductive element, and wherein the relationship of the inductances L1', L2' and L3' of the first, second and third inductive elements, respectively, are chosen so as to reduce power dissipation in the first and second controlled switching elements.

12. The circuit as claimed in claim 11 wherein said inductances L1', L2' and L3' satisfy the following relationship $$L3'>5*L1' \text{ and } L3'>5*L2'.$$

13. The circuit as claimed in claim 11 wherein the power dissipation in the inverter is further reduced by means of third and fourth unidirectional elements connected in series aiding to the first and second input terminals and with a common first circuit point therebetween coupled to a common second circuit point between the first and second controlled switching elements.

14. The circuit as claimed in claim 11 wherein the operating circuit includes parasitic capacitances that, with the first and second inductive elements, tend to produce parasitic oscillations, the operating circuit further comprising:

means for suppressing parasitic oscillation and which comprise third and fourth unidirectional elements connected in series aiding to the first and second input terminals and with a first circuit point therebetween coupled to a second circuit point between the first and second controlled switching elements.

15. The circuit as claimed in claim 11 wherein the first and second controlled switching elements comprise field effect transistors each having an internal diode, and wherein the power dissipation in the inverter is further reduced by third and fourth unidirectional elements connected in series with the first and second controlled switching elements, respectively, wherein the choice of third and fourth unidirectional elements is such that the third and fourth unidirectional elements operate at a high speed with respect to the internal diodes of the first and second FET controlled switching elements.

16. The circuit as claimed in claim 11 wherein the first and second controlled switching elements comprise field effect transistors each having an internal diode, and wherein the power dissipation in the inverter is further reduced by third and fourth unidirectional elements connected in parallel with the first and second FET controlled switching elements, respectively, wherein the choice of third and fourth unidirectional elements is such that the third and fourth unidirectional elements operate at a high speed with respect to the internal diodes of the first and second FET controlled switching elements.

17. The circuit as claimed in claim 12 wherein the load branch includes the third inductive element, the lamp connection terminals, and the first capacitive element coupled in series circuit across the second unidirectional element and the second controlled switching element.

18. The circuit as claimed in claim 17 further comprising:

third and fourth unidirectional elements connected in series aiding to the first and second input terminals and with a first circuit point therebetween coupled to a second circuit point between the first and second controlled switching elements, and the load branch is coupled to the second circuit point.

19. The circuit as claimed in claim 11 wherein the control circuit includes a dimmer circuit for regulating the duty cycle of the control signal, the inductance L3' is greater than each of the inductances L1' and L2', and the inductance L1' is approximately equal to the inductance L2'.

20. A circuit for operating a discharge lamp comprising:

first and second input terminals for connection to a source of DC supply voltage for the circuit, an inverter coupled to the first and second input, terminals and comprising a series circuit of a first controlled switching element, a first inductive element, a second inductive element and a second controlled switching element, a control circuit coupled to respective control electrodes of the first and second controlled switching elements to drive the first and second controlled switching elements alternately conducting and non-conducting, a load branch comprising a third inductive element, lamp terminals for connection to the discharge lamp, and a first capacitive element, a first unidirectional element coupled between the second input terminal and a circuit point between the first controlled switching element and the first inductive element, a second unidirectional element coupled between the first input terminal and a circuit point between the second controlled switching element and the second inductive element, and wherein the relationship of the inductances L1', L2' and L3' of the first, second and third inductive elements, respectively, are chosen so as to suppress power dissipation in the inverter, and said inductances L1', L2' and L3' satisfy the following relationship $$L3' > 10 * L1' \text{ and } L3' > 10 * L2'.$$

* * * * *